US008287153B2

(12) United States Patent
Leung et al.

(10) Patent No.: US 8,287,153 B2
(45) Date of Patent: Oct. 16, 2012

(54) FLAT MODULUS LIGHT SOURCE

(75) Inventors: Sue-Anne Tean Leung, Hong Kong (CN); Eddie Ping Kuen Li, Hong Kong (CN)

(73) Assignee: Huizhou Light Engine Ltd., Guangdong (CN)

( * ) Notice: Subject to any disclaimer, the term of this patent is extended or adjusted under 35 U.S.C. 154(b) by 154 days.

(21) Appl. No.: 12/954,034

(22) Filed: Nov. 24, 2010

(65) Prior Publication Data

US 2012/0081903 A1 Apr. 5, 2012

Related U.S. Application Data

(60) Provisional application No. 61/389,496, filed on Oct. 4, 2010.

(51) Int. Cl.
*F21S 4/00* (2006.01)
*F21V 21/00* (2006.01)

(52) U.S. Cl. ..... 362/249.02; 362/800

(58) Field of Classification Search . 362/249.02–249.06
See application file for complete search history.

(56) References Cited

U.S. PATENT DOCUMENTS 6,149,283 A 11/2000 Conway et al.
2004/0264195 A1 12/2004 Chang et al.
2007/0047238 A1 3/2007 Vukosic et al.
2007/0285926 A1 12/2007 Maxik
2007/0296350 A1 12/2007 Maxik et al.
2008/0157112 A1 7/2008 He et al.
2009/0219732 A1 9/2009 Gingrich, III et al.
2009/0290349 A1 11/2009 Chu et al.

OTHER PUBLICATIONS

PCT Notification of Transmittal of The International Search Report and The Written Opinion of the International Searching Authority, or the Declaration issued on Jan. 21, 2011 concerning PCT International Application No. PCT/US2010/058050.

*Primary Examiner* — Jason Moon Han
(74) *Attorney, Agent, or Firm* — Dickstein Shapiro LLP

(57) ABSTRACT

A lighting apparatus comprises: an upper housing having a graduated stepped cylindrical profile, forming an upper portion of the lighting apparatus; a substantially annular heat sink having a round profile around its outer periphery and a hexagonal profile around its inner periphery, and being shaped so as to have an opening at the bottom of the heat sink; a plurality of LEDs located around the inner periphery of the heat sink, the LEDs being oriented so as to emit light in an upward direction at an angle; and a hexagonal reflector situated between the upper housing and the heat sink, the hexagonal reflector having a downwardly reflective lower surface. When the lighting apparatus is assembled and power is applied to the LEDs, light emitted from the LEDs is reflected off of the lower surface of the reflector so as to exit through the opening at the bottom of the heat sink.

8 Claims, 4 Drawing Sheets

FLAT MODULUS LIGHT SOURCE

CROSS-REFERENCE TO RELATED APPLICATION

This application claims benefit under 35 U.S.C. §119(e) to U.S. Provisional Patent Application No. 61/389,496, filed Oct. 4, 2010, which is hereby incorporated by reference.

BACKGROUND OF THE INVENTION

The present invention relates to a lighting apparatus used for lighting. In a preferred embodiment, the lighting apparatus is flat modulus light source having an LED light source that includes one or more LED chips.

Conventionally, light bulbs for light sources may be compact fluorescent bulbs, or incandescent bulbs. In recent years LEDs have been proposed and used in lighting, for example LEDs with individual collimated lenses. However, such LED lights do not provide for a uniformity of the light coming from the light source and therefore might cause discomfort to the eyes.

Lighting units that use light reflected from LEDs are known. In particular, Lithonia lighting downlight DOM6 LED 600L 3500K 120HSG provides a downlight in which light is reflected down. However, the Lithonia unit is a large and heavy fixture, with a heat sink at the top of the unit, and is incompatible with standard light fixture standards, such as GX53. Thus, the need exists for a light with a small profile and with light weight, and one that may be used as a light bulb, for example as a replacement bulb with standard light sockets, while at the same time providing uniform light without causing discomfort to the eyes.

BRIEF SUMMARY OF THE INVENTION

In accordance with one aspect of the present invention, a lighting apparatus comprises: an upper housing having a graduated stepped cylindrical profile, forming an upper portion of the lighting apparatus; a substantially annular heat sink having a round profile around its outer periphery and a hexagonal profile around its inner periphery, and being shaped so as to have an opening at the bottom of the heat sink; a plurality of LEDs located around the inner periphery of the heat sink, the LEDs being oriented so as to emit light in an upward direction at an angle; and a hexagonal reflector situated between the upper housing and the heat sink, the hexagonal reflector having a downwardly reflective lower surface. When the lighting apparatus is assembled and power is applied to the LEDs, light emitted from the LEDs is reflected off of the lower surface of the reflector so as to exit through the opening at the bottom of the heat sink.

In another aspect, the lighting apparatus further comprises an AC to DC driver that converts power from outside the light source into signals appropriate for driving the LEDs.

In another aspect, the AC to DC driver is snap fit into an interior portion of the upper housing and includes knobs which protrude from holes in an upper portion of the upper housing, the knobs being configured to mate with a light fixture/socket to provide power to the AC to DC driver.

In another aspect, the AC to DC driver is snap fit into an interior portion of the upper housing and includes first wires which extend from one or more holes in an upper portion of the upper housing, the first wires being configured to couple with an outside power source to provide power to the AC to DC driver.

In another aspect, the inner periphery of the heat sink is hexagonal in shape.

In another aspect, the LEDs are mounted on a flexible PCB that is folded so as to lie on a surface of the inner periphery of the heat sink.

In another aspect, the LEDs are mounted on circuitry directly printed on a surface of the inner periphery of the heat sink, the circuitry comprising a copper layer on which the LEDs are affixed, the copper layer being coupled to the AC to DC driver.

In another aspect, the inner periphery is angled.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE INVENTION

Figure 1:
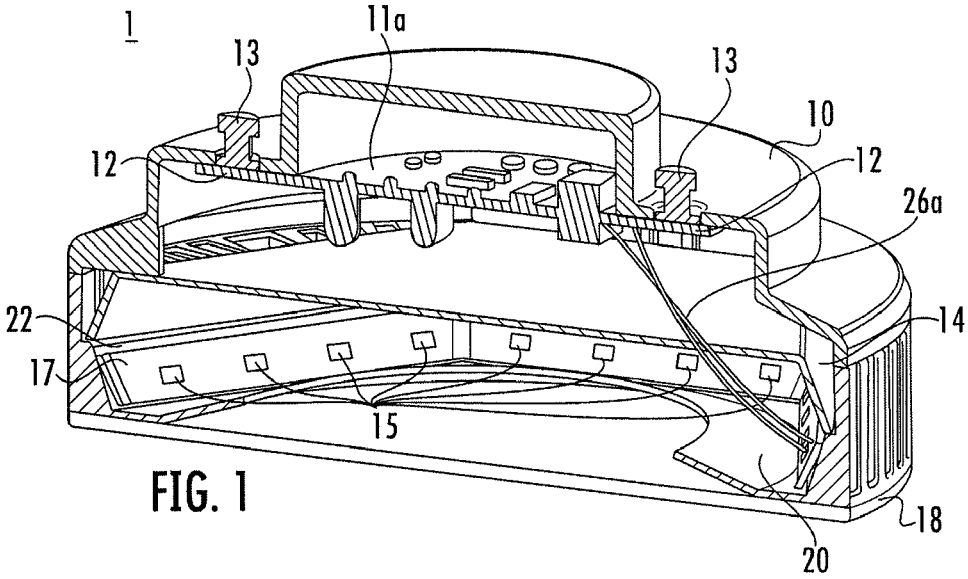
FIG. 1 is a cross-sectional view of a flat module light source in accordance with an embodiment of the present invention.

FIGS. 1-4B illustrate a first preferred embodiment of a flat module light source, in accordance with the present invention. As can be seen in the figures, a flat module light source 1 in accordance with an embodiment of the present invention is formed of an upper housing 10, an AC to DC driver module 11*a* having wings 12 having mounted thereon knobs 13. A reflective portion 14, having a reflective upper surface, is provided, as well as a heat sink 16 and a lens cover 18.

The upper housing 10 is preferably formed with a graduated cylindrical shape as shown in the figures. Preferably, the driver module 11 is mountable within the housing 10 by snap fit or screwing into the surface of the second largest circumference of the housing. The housing 10 is formed so as to allow the outermost (i.e., largest circumference) portion to snugly fit around the upper edge of the heat sink 16 when assembling the light source 1. Preferably, the innermost portion of the upper housing is sized so as to allow the light source 1 to be compatible with and fit snugly within a standard light socket/fixture, such as the known GX53 socket/fixture. The upper housing 10 is preferably formed of plastic or other moldable material.

The reflective portion 14 is preferably hexagonal in shape with a reflective surface on a lower surface thereof. The reflective surface can be provided by making the reflective portion 14 out of a reflective metal, or by the use of reflective paint. The reflective portion 14 rests on and mates with a hexagonal inner ring 22 formed in the heat sink 16. LEDs 15 are mounted around the inner periphery of the heat sink 16, on a surface of the inner ring 22.

In one preferred embodiment, the LEDs are mounted on a flexible PCB (FPCB) 17 folded in a hexagonal shape and affixed, e.g., by gluing, onto the inner surface 22 of the heat sink 16. Electrical connection between the driver module 11 and the FPCB is provided by wires 26*a*. While the illustrated embodiment shows a folded FPCB, the invention is not limited to this configuration. For example, small pieces of PCB could be provided, one for each LED, with a wired connection between each PCB to enable power connection. As another example, the LEDs can be mounted on circuitry, such as an insulator and a copper layer, that is directly printed on the inner surface of the heat sink. Such an embodiment will be discussed below with reference to FIGS. 3A and 3B.

The bottom of the heat sink 16 includes an annular lower portion 20 that is arched upward toward the center of the heat sink 16, the inner portion forming an aperture for allowing reflected light from the LEDs to exit the light source 1. The hexagonal rim forming the inner surface 22 is preferably formed around the inner periphery of the heat sink 16.

Preferably, the light source 1 includes a bottom cap or lens cover 18. The lens cover 18 can be made of plastic or other similar material and may be frosted (i.e., light diffusing) to provide for more scattered light, for the comfort of the eye. The lens cover 18 can also be clear. In any event, in addition to modifying the light, the lens cover protects the light source 1 from dust, dirt and moisture. It is also contemplated that the lens cover 18 can comprise a collimated lens or a plurality of such lenses, to achieve a tighter angle for the light emitted from the light source 1.

Figure 2:
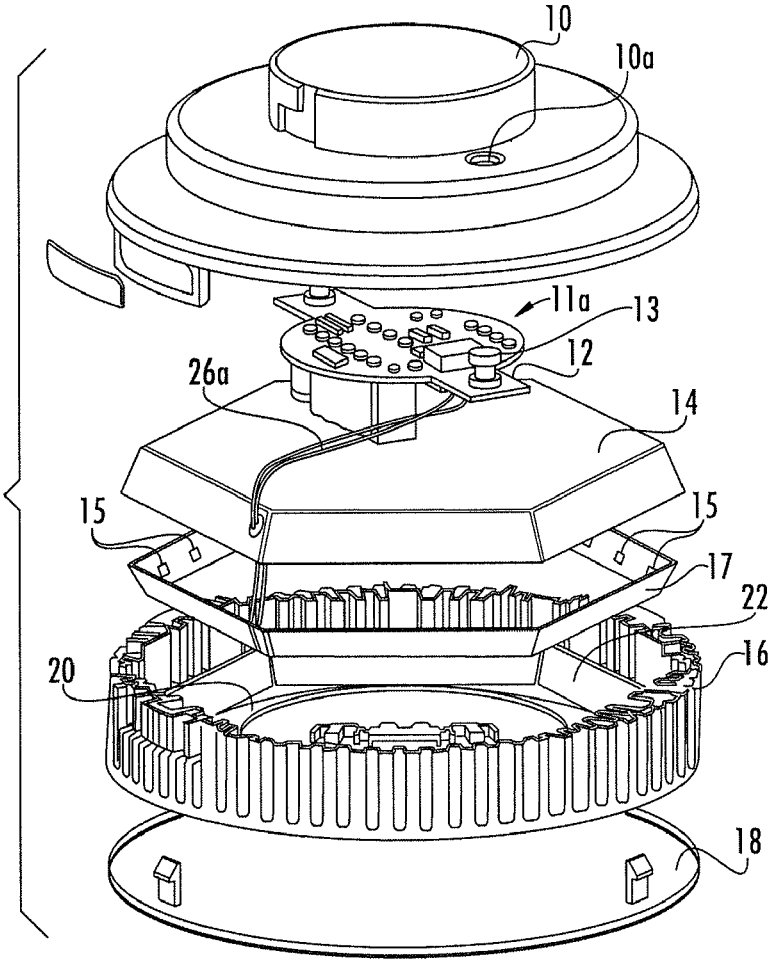
FIG. 2 is an exploded parts view of a flat module light source in accordance with an embodiment of the present invention.

In the embodiment shown in FIGS. 1 and 2 the light source supplies power to the LEDs using the AC/DC driver module 11*a*. The AC to DC driver module 11*a* preferably has wings 12 having mounted thereon knobs 13. The knobs 13 are provided to, e.g., to get power when fixed to a lamp socket, for example a GX53 lamp socket, and apply the power to the AC to DC driver module, which converts the incoming power to DC signals that can be used to drive the LEDs. The actual circuitry that forms the AC to DC driver can be of any known type for converting AC power to DC driving signals. The DC signals are then provided to the FPCB 17 via wires 26*a* for driving the LEDs.

The AC to DC driver module 11*a* having the wings 12 and the knobs 13 would preferably be of a profile compatible with a standard light fixture mounting standard, such as the known GX53 standard, allowing the light source to be mounted into any standard GX53 lamp socket. Thus, the knobs 13 can be configured to be compatible which such a light socket. Of course the present invention is not limited to having a shape compatible with the GX53 lamp socket. Preferably the AC to DC driver module 11*a* is formed so as to allow the AC to DC driver module 11*a* to be snap fit or screwed into the interior of the upper housing 10.

Figure 3A:
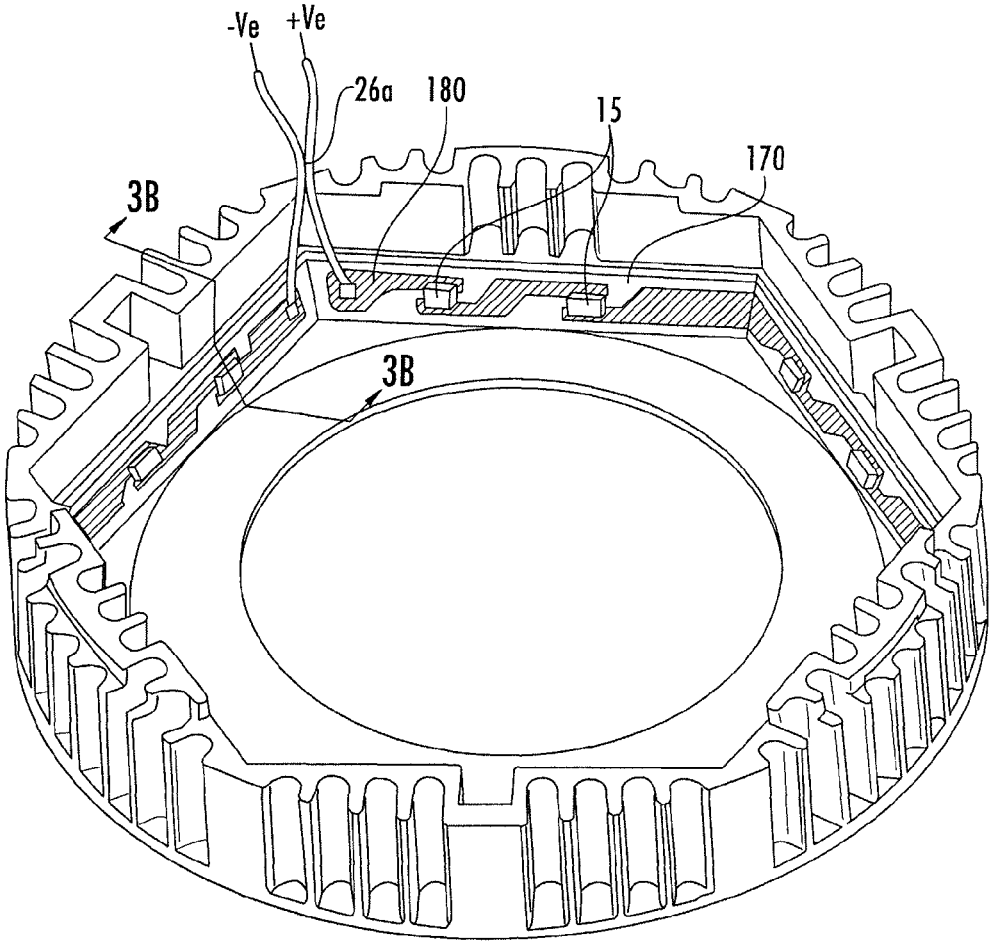
FIG. 3A is a perspective view of a heat sink portion with LEDs and associated circuitry used in a flat module light source in accordance with an embodiment of the present invention.
Figure 3B:
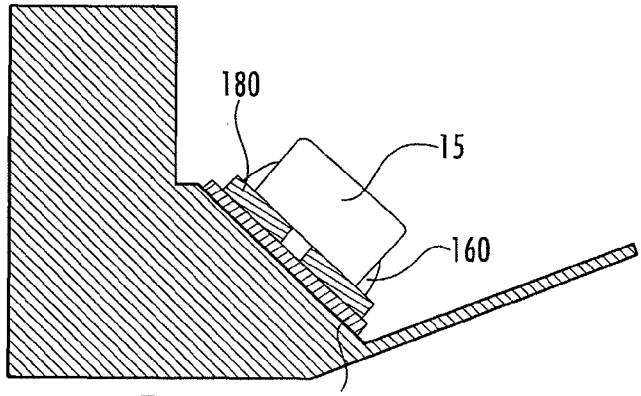
FIG. 3B is a cross-sectional view of the heat sink portion shown in FIG. 3A along the line 3B.

FIGS. 3A and 3B show another method of applying the LEDs to the inner surface 22 of the heat sink 16. In this embodiment, rather than use the FPCB, the LEDs are attached, for example by solder joints 160, to circuitry that has been directly printed on the inner surface 22 of the heat sink. The directly printed circuitry has an insulator 170, and a copper layer 180. The circuitry receives voltage for driving the LEDs from wires 26*a*, which are coupled to copper layer 180 and are also soldered and connected to the AC to DC driver module 11*a*. The wires 26*a* run through the upper housing 10. The copper layer 180 comprises the circuitry for applying the driving and other voltages to the individual LEDs. For example, the copper layer 180 may have a thickness of about 0.1 mm. The walls of the inner surface of the hexagonal rim 22 are angled upwardly diagonally so that the light from the LEDs goes up at an angle. The upwardly angled light will then be reflected against the reflective portion 14, and then downwardly out of the bottom of the light source 1. The types of LEDs used may vary depending on the brightness and heat dissipation, but may include, for example Cree MX6 or Cree XPE LEDs.

In assembling the light source 1, hexagonal the reflective portion 14 is placed over the hexagonal rim 22, to rest atop the rim 22. This configuration advantageously allows light being emitting upwardly from the LEDs to reflected at a downward angle and out of the bottom of the light source 1. The upper housing 10 is affixed to the heat sink, for example, by a snap fit. If the lens 18 is used, it also attaches to the bottom of the heat sink, for example by a snap fit.

Figure 4A:
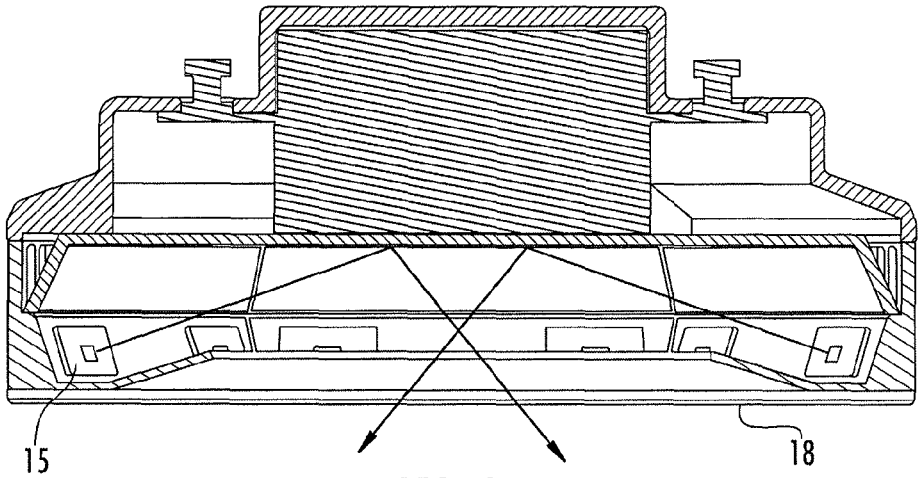
FIGS. 4A and 4B are side cross-sectional views of the flat module light source in accordance with an embodiment of the present invention.
Figure 4B:
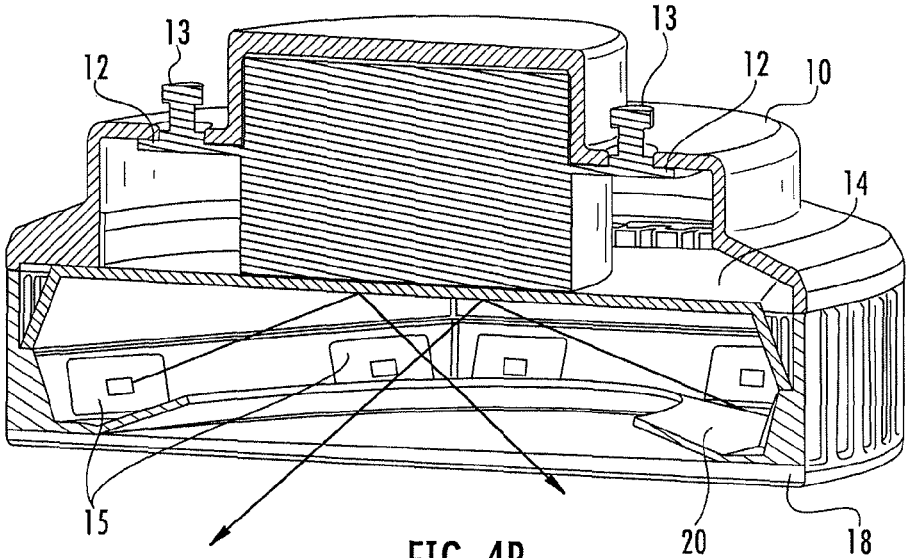

FIGS. 4A and 4B are functional cross sectional views of a light source in accordance with one aspect of the present invention, but without showing details of the circuitry or AC to DC driving circuits discussed above. The arrows in FIGS. 4A and 4B illustrate how the light emitted from the LEDs 15 strikes the reflector 14, and is redirected out of the bottom of the light source 1. In FIGS. 4A and 4B, the path of light from the LEDs 15 is shown by the arrows as reflecting off the reflective surface 14 and then down out of the light source 1.

Figure 5:
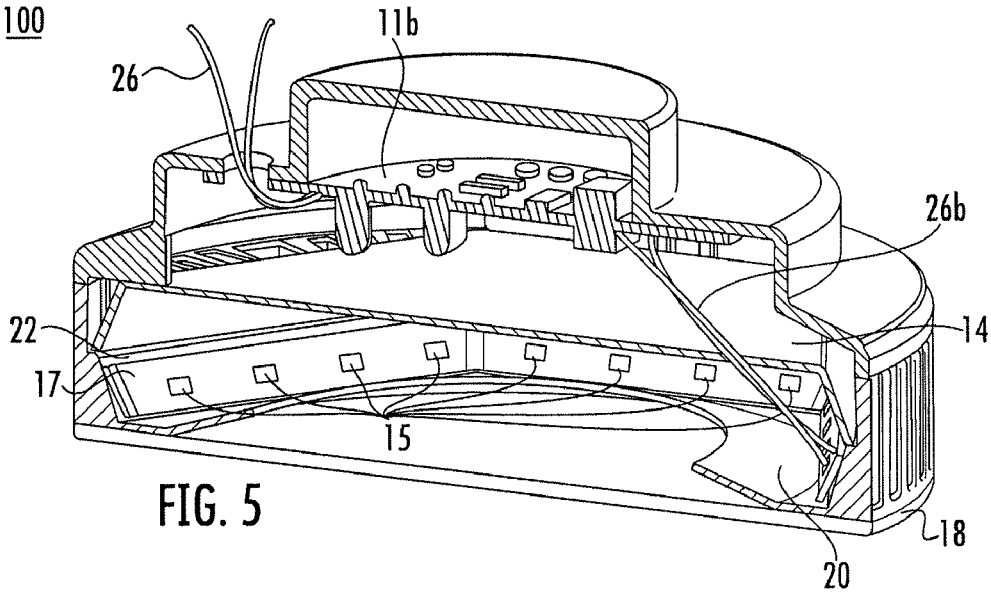
FIG. 5 is a cross-sectional view of a flat module light source in accordance with another embodiment of the present invention.
Figure 6:
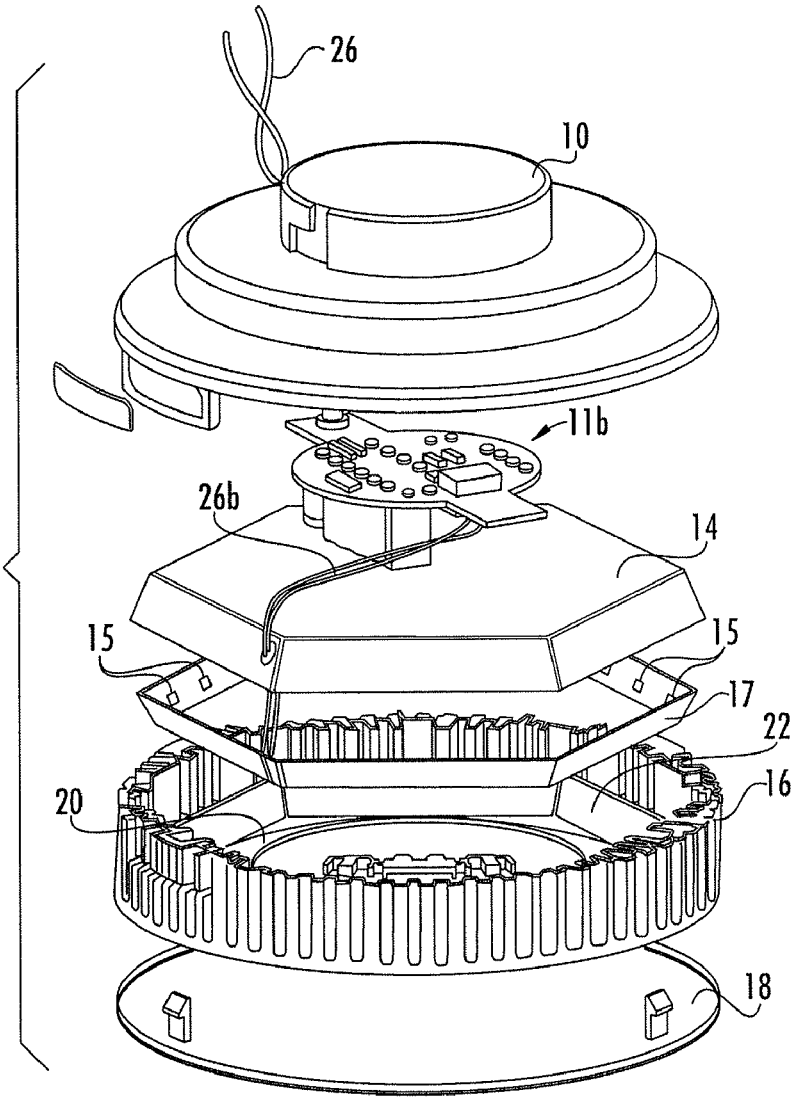
FIG. 6 is an exploded parts view of a flat module light source in accordance with the embodiment of the present invention shown in FIG. 5.

In the embodiment shown in FIGS. 1 and 2 the light source supplies power to the LEDs using the AC/DC driver module 11*a* having knobs 13 for coupling to outside power supply, such as AC power from the wall or ceiling. Another embodiment is shown in FIGS. 5 and 6. In the embodiment shown in FIGS. 5 and 6, instead of the light source receiving outside power from knobs in the AC to DC driver module, wires 26 are provided for supplying AC power to an AC to DC driver module 11*b*.

As can be seen from the figures, wires 26 enter a hole in the top of the upper housing 10 and are connected to the AC to DC driver module 11*b*. Just as was the case in the embodiment of FIGS. 1 and 2, the signals converted by the driver module 11*b* are supplied to the LEDs via wires 26*b*, which connects to the FPCB 17. The other components of the embodiment shown in FIGS. 5 and 6 having like reference numerals are identical to those described in FIGS. 1-4B, and the light source functions in the same manner, for example as shown in FIGS. 4A and 4B. As was the case with regard to the configuration shown in FIGS. 1 and 2, in the configuration shown in FIGS. 5 and 6, the LEDs can be attached to the FPCB 17, or alternatively to individual small pieces of PCB, or with the directly printed circuitry as shown in FIGS. 3A and 3B. The description of those identical aspects will not be repeated here.

The use of wires 26 instead of knobs allows flexibility to allow connection to other socket types or wired connections. The wires can be connected to any plugs to suit power sockets for different countries or the wiring can be done directly by electricians to connect to external power. Depending on the driver design and whether AC or DC will be used, there may be 2-3 wires. In the case of 2 wires, the wires would typically be live and neutral. If 3 wires, live, neutral and ground.

The lens cover 18 in either embodiment is preferably a transparent, frosted or otherwise light diffusing cover that softens the light from the LEDs 15 that has been reflected down. The lens cover 18, is shaped at its upper edge so as to couple, for example by a snap-fit, to the heat sink 16 The cover 18 is preferably made of transparent polymer such as PC, PMMA, PVC or PU having a high light transmissivity, or other plastic or glass, or any other material that can pass light.

Although specific embodiments have been illustrated and described herein, it will be appreciated by those of ordinary skill in the art that a variety of alternate and/or equivalent implementations may be substituted for the specific embodiments shown and described without departing from the scope of the present invention. This provisional application is intended to cover any adaptations or variations of the specific embodiments discussed herein. Therefore, it is intended that this invention be limited only by the claims and the equivalents thereof.

What is claimed is:

1. A lighting apparatus comprising:

an upper housing having a graduated stepped cylindrical profile, forming an upper portion of the lighting apparatus;

a substantially annular heat sink having a round profile around its outer periphery and a hexagonal profile around its inner periphery, and being shaped so as to have an opening at the bottom of the heat sink;

a plurality of LEDs located around the inner periphery of the heat sink, the LEDs being oriented so as to emit light in an upward direction at an angle; and a hexagonal reflector situated between the upper housing and the heat sink, the hexagonal reflector having a downwardly reflective lower surface that is on top of the heat sink, wherein, when the lighting apparatus is assembled and power is applied to the LEDs, light emitted from the LEDs is reflected off of the lower surface of the reflector so as to exit through the opening at the bottom of the heat sink.

2. The lighting apparatus according to claim 1, further comprising an AC to DC driver that converts power from outside the light source into signals appropriate for driving the LEDs.

3. The lighting apparatus according to claim 2, wherein the AC to DC driver is snap fit into an interior portion of the upper housing and includes knobs which protrude from holes in an upper portion of the upper housing, the knobs being configured to mate with a light fixture/socket to provide power to the AC to DC driver.

4. The lighting apparatus according to claim 2, wherein the AC to DC driver is snap fit into an interior portion of the upper housing and includes first wires which extend from one or more holes in an upper portion of the upper housing, the first wires being configured to couple with an outside power source to provide power to the AC to DC driver.

5. The lighting apparatus according to claim 1, wherein the inner periphery of the heat sink is hexagonal in shape.

6. The lighting apparatus according to claim 1 or 5, wherein the LEDs are mounted on a flexible PCB that is folded so as to lie on a surface of the inner periphery of the heat sink.

7. The lighting apparatus according to claim 2 or 5, wherein the LEDs are mounted on circuitry directly printed on a surface of the inner periphery of the heat sink, the circuitry comprising a copper layer on which the LEDs are affixed, the copper layer being coupled to the AC to DC driver.

8. The lighting apparatus according to claim 1, wherein the inner periphery is angled.

* * * * *